United States Patent [19]

Okamoto et al.

[11] Patent Number: 5,025,263

[45] Date of Patent: Jun. 18, 1991

[54] MULTI-FREQUENCY ANTENNA

[75] Inventors: Kengo Okamoto; Takaaki Habu; Shoji Muroi, all of Saitama, Japan

[73] Assignee: Nippon Antenna Co., Ltd., Tokyo, Japan

[21] Appl. No.: 453,399

[22] Filed: Dec. 19, 1989

Related U.S. Application Data

[63] Continuation-in-part of Ser. No. 285,852, Dec. 16, 1988, abandoned.

[30] Foreign Application Priority Data

Dec. 25, 1987 [JP] Japan ..... 62-329369

[51] Int. Cl.[5] ..... H01Q 1/100; H01Q 1/320; H01Q 9/000

[52] U.S. Cl. ..... 343/715; 343/901

[58] Field of Search ..... 343/711, 712, 713, 714, 343/715, 900, 901, 722, 749, 903

[56] References Cited

U.S. PATENT DOCUMENTS

| | | | |
|---|---|---|---|
| 4,353,075 | 10/1982 | Edwards | 343/903 |
| 4,464,664 | 8/1984 | Edwards | 343/715 |
| 4,527,168 | 7/1985 | Edwards | 343/901 |
| 4,675,687 | 6/1987 | Elliot | 343/722 |
| 4,725,846 | 2/1988 | Hendershot | 343/715 |
| 4,748,450 | 5/1988 | Hines et al. | 343/901 |
| 4,764,773 | 8/1988 | Larsen et al. | 343/715 |
| 4,829,317 | 5/1989 | Shinkawa | 343/903 |

FOREIGN PATENT DOCUMENTS

| | | | |
|---|---|---|---|
| 2355002 | 5/1975 | Fed. Rep. of Germany | 343/715 |
| 0231904 | 12/1984 | Japan | 343/901 |
| 0213303 | 9/1987 | Japan . | |
| 0042507 | 2/1988 | Japan . | |
| 8700351 | 1/1987 | World Int. Prop. O. . | |

*Primary Examiner*—Michael C. Wimer
*Assistant Examiner*—Peter Toby Brown
*Attorney, Agent, or Firm*—Flynn, Thiel, Boutell & Tanis

[57] ABSTRACT

A multi-frequency antenna to be used commonly for reception of multiple different frequencies includes first and second rods extendably held by and through a third rod. The first rod is coupled to the second rod via a phase shifter so that when the first and second rods are fully extended, the antenna behaves as a high gain antenna for common use in an AM, FM and car telephone system.

4 Claims, 5 Drawing Sheets

MULTI-FREQUENCY ANTENNA

This application is a Continuation-in-Part of application Ser. No. 07/285.852, filed Dec. 16, 1988, now abandond.

FIELD OF THE INVENTION

This invention relates to a multi-frequency antenna, and more particularly to an improvement of an antenna for AM, FM and car telephone frequencies suitable for a motor driving system.

BACKGROUND OF THE INVENTION

As prior art car antennas for reception of different frequencies, there are arrangements disclosed in JP-U-60-10092B, JP-P-62-179202A and JP-P-62-245805A in which all rods forming each antenna are extended and retracted by a motor-driven system.

A problem of the prior art antennas is that a power feeding cable is caught in rods connected thereto during their retracting movements, and this often causes a malfunction. There are further drawbacks that the directivity and the gain are insufficient and that the structure is complicated and expensive.

OBJECT OF THE INVENTION

It is therefore an object of the invention to provide a multi-frequency antenna free from cable winding troubles and having a simple, inexpensive arrangement and a high gain.

SUMMARY OF THE INVENTION

In order to achieve the object, the invention provides a multi-frequency antenna for reception of multiple different frequencies comprising: a first rod; a second rod coupled to said first rod via a phase shifter for relative extending and contracting movements; a third rod capable of accepting and storing said first and second rods therethrough; an outer pipe disposed outside said third rod to support same immovable, said outer pipe being supported by a car body, etc. and grounded at a predetermined position, said outer pipe and said third rod being configured to establish an impedance matching; and a power feeding line connected to said third rod.

Since the third rod and the outer pipe have an open trap arrangement to establish an impedance matching, and the power feeding point is fixed to the third rod, the first and second rods, when driven by a motor, for example, to fully extended positions with respect to the third rod, are capable of receiving AM, FM and car telephone frequencies. Further, since the power feeding cable is connected to the stationary third rod, there is no possibility that the cable is caught by rods into a jam. Beside this, since the phase shifter is provided between the first rod and the second rod, a high gain is established.

DETAILED DESCRIPTION

Figure 1:
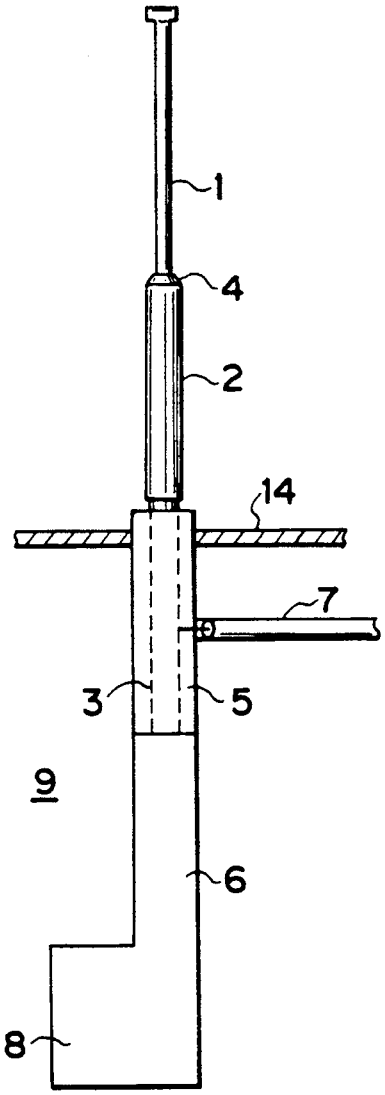
FIGS. 1 through 4 are schematic views showing an embodiment of the invention.
Figure 2:
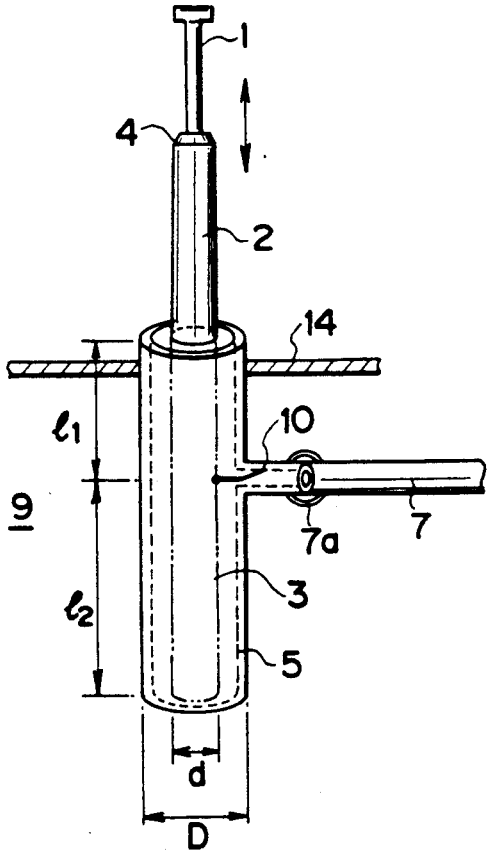
Figure 3:
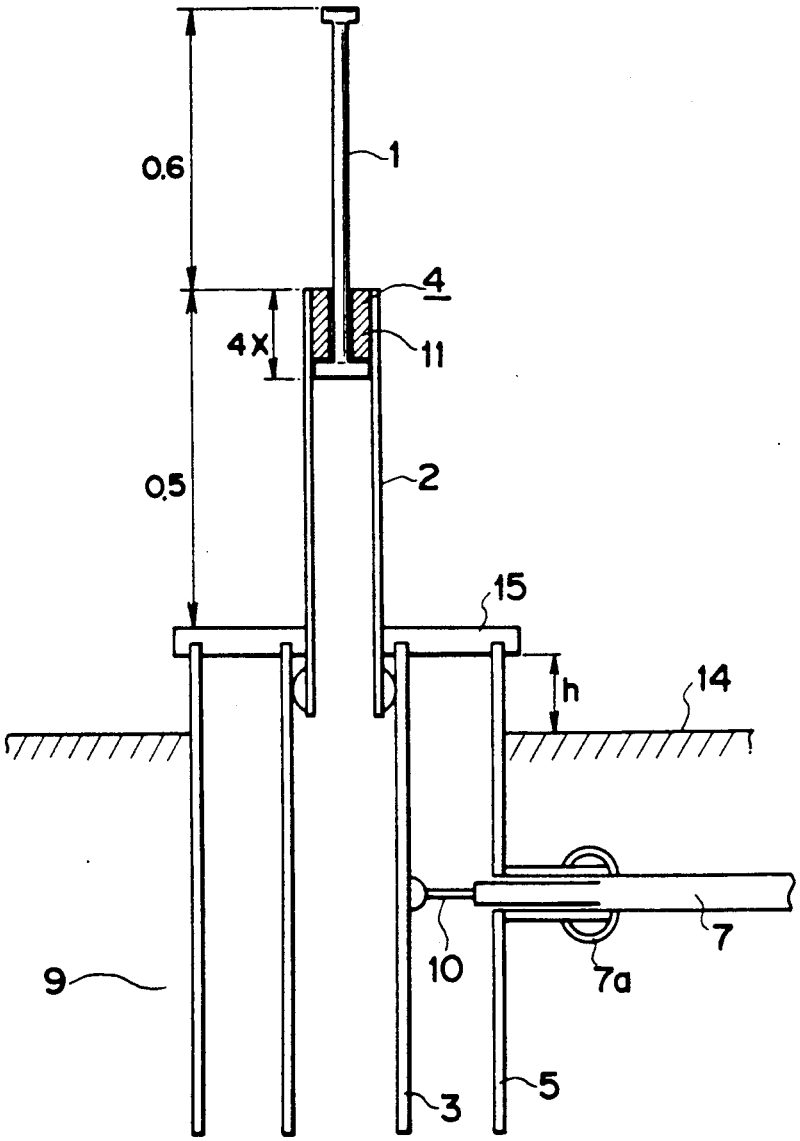

The invention is described below, referring to a preferred embodiment illustrated in the drawings. FIGS. 1 through 3 show an embodiment of a multi-frequency antenna according to the invention. Reference numerals 1, 2 and 3 denote first, second and third metal rods. The first and second rods 1 and 2 are coupled for relative movement between extended and retracted positions. Inside the second rod 2 at the junction with the first rod 1 is disposed a phase shifter 4.

Outside the third rod 3 is provided an outer metal pipe 5 via an insulating cap 15. The outer pipe 5 is grounded to a car body 14, for example, at a predetermined position and supported by a resin lower pipe 6 therein.

A core 10 of a power feeding coaxial cable 7 is connected to the third rod 3, and an outer skin earth or shield 7*a* of the cable 7 is connected to the outer pipe 5.

The first and second rods 1 and 2 are driven by a motor assembly 8 in the lower pipe 6 to an extended or retracted position, using a known driving system. They are fully extended with respect to the third rod 3 when the antenna is used, but they are retracted into the interior of the third rod 3 for storage therein when the antenna is not used.

By connecting the core 10 of the coaxial cable 7 to the third rod 3 (housing pipe) as described above, an antenna base 9 has a coaxial line arrangement of an open trap type. In the coaxial line, the first and second rods 1 and 2 alone are extendable, and the third rod is fixed and stationary. Therefore, in the interior of the outer pipe 5, the impedance never becomes discontinuous, and a good high frequency line is established.

The interior impedance $Z_0$ of the outer pipe 5 is calculated by $$Z_0 = \frac{138}{\sqrt{\epsilon l}} \log 10 \frac{D}{d}.$$

In this antenna, however, considering the outer diameter d of the third rod 3, inner diameter D of the outer pipe 5 and dielectric constant $\epsilon l$, $Z_0 \simeq 4\ 5 \sim 5\ 5\ \Omega$, for example, is selected.

By using the antenna base of the above-indicated coaxial line arrangement, also when the first and second rods 1 and 2 fail to extend to an acceptable length due to a malfunction of the motor driving mechanism, etc., changes in the impedance are relatively small, so that a wireless system connected to the inventive antenna is protected against damages caused by a deterioration of VSWR, and the decrease in the gain is relatively small and practically acceptable.

For example, when the second rod 2 extends while the first rod 1 is held in the second rod 2, the length of about 0.5λ of the second rod 2 (the antenna gain is about 1 dB) is practically acceptable.

Figure 4:
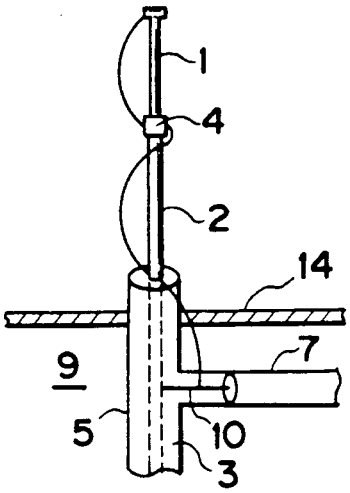

As shown in FIG. 4, this antenna is a modification of an open sleeve type antenna in which the third rod 3 and the outer pipe 5 at the antenna base 9 are imbedded by ¼λ approximately under a grounded plate 14 (car body, etc.). In this arrangement, the antenna impedance and the impedance of the power feeding portion can be readily matched inside the outer pipe 5 by adjusting the proportion D/d between the inner diameter D of the outer pipe 5 and the outer diameter d of the third rod 3 and adjusting the length ( to the power feeding point.

Further, by changing the height h of the upper end of the antenna base 9 from the grounded plate 14, the elevation angle and the horizontal gain of the antenna of the invention may be changed. Additionally, since the lower part ($l_2$) below the power feeding point behaves as an open trap, matching at the power feeding point is easy.

Particularly, the antenna of the invention is provided with the phase shifter 4 between the first rod and the second rod. This makes it possible to use a particular arrangement at the upper end of the second rod 2 as shown in FIG. 5 to obtain a good phase inverting function and to increase the antenna gain.

Figure 5:
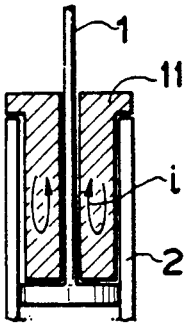
FIGS. 5 through 7 are views showing a phase shifter.

In FIG. 5, reference numeral 11 designates a dielectric element made from polyacetal resin, etc. and used as a phase shifter. Its length is $\frac{1}{4}(\lambda \times \delta)$ ($\delta$ is the reduction constant determined by the material and shape of the dielectric element 11) for use in a car telephone system near 900 MHz, and the lengths of the first and second rods 1 and 2 are selected to be about 0.6λ and 0.5λ respectively as shown in FIG. 3.

Figure 6:
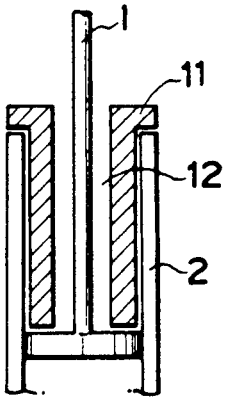
Figure 7:
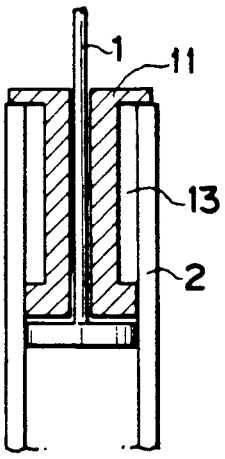

When the dielectric element 11 as the phase shifter has a configuration shown in FIG. 5, flows of currents i in the phase shifter are opposite as illustrated, and no electric wave is radiated from this portion. Modified examples based on this theory are shown in FIGS. 6 and 7. In these drawings, numerals 12 and 13 denote openings defined between the dielectric element 11 and the first and second rods 1 and 2. Since the effective dielectric constant can be changed under these arrangements, the wavelength $\lambda_2$ inside the phase shifter is changed to $$\lambda_2 = \frac{\lambda}{4}\left(1 + \frac{1}{\sqrt{\epsilon l}}\right).$$

Further, since the length of the reverse current path varies, the antenna gain and phase vary, so that the main beam angle and the magnitude of the side lobe can be changed.

When using the antenna of the invention to receive AM and FM signals, an appropriate coupler is connected to the coaxial cable.

Figure 8:
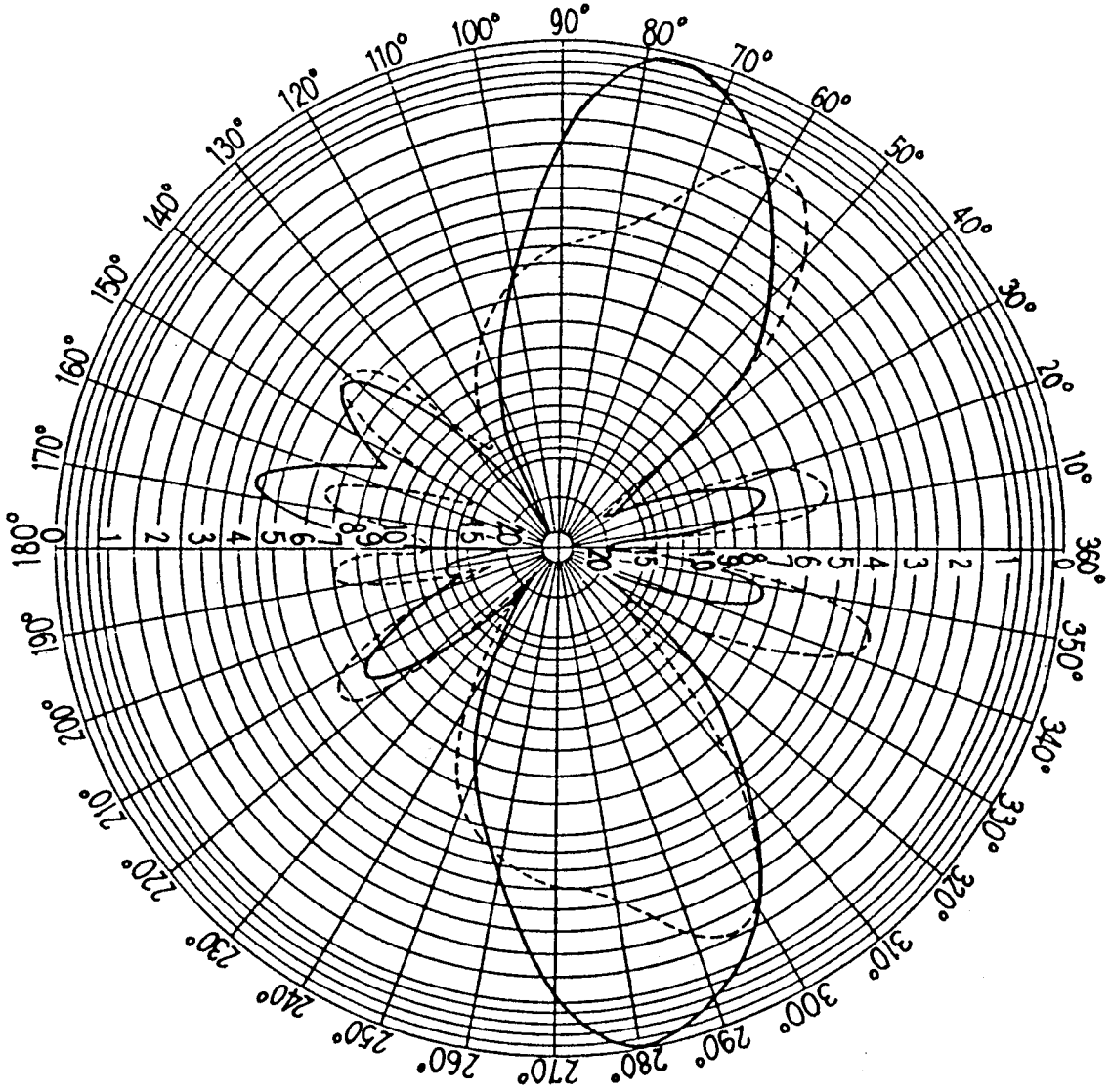
FIG. 8 is a real measurement diagram showing a directivity pattern of the antenna of the invention.

FIG. 8 shows a wave radiation pattern of the antenna of the invention where the solid line corresponds to the fully extended state of the antenna and the dotted line corresponds to a configuration where the second rod 2 alone is extended. The drawing shows that the antenna of the invention is almost all-directional and sufficiently available for practical use not only in the fully-extended state but also by extension of the second rod alone.

As described above, according to the invention, since the third rod connected to the power feeding cable is stationary, an entangled winding of the power feeding cable during use is prevented, and the structure is simplified and economical. Further, since the phase shifter having a particular structure is used between the first rod and the second rod, the gain is high. Moreover, since the third rod and the outer pipe form a power feeding system of an open trap structure, the antenna of the invention has a wide band property which can be used for AM, FM and car telephone systems.

Figure 9:
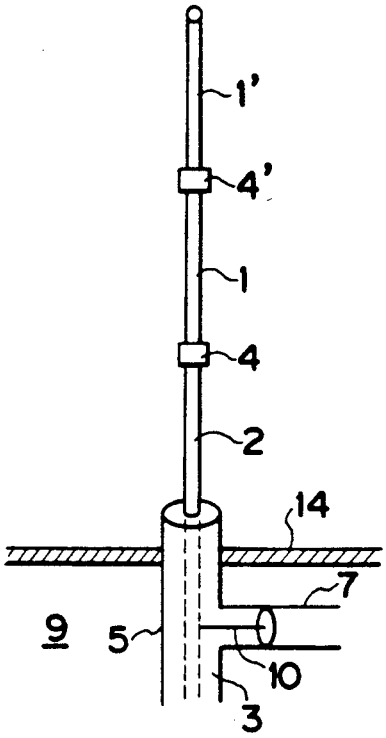
FIGS. 9 to 11 are schematic views showing further embodiments of the invention.

FIG. 9 shows a further embodiment of the invention in which a fourth metal rod 1' is added to the metal rod 1 of the embodiment of FIG. 4 via a phase shifter 4' so as to be contained in or extended from the first metal rod 1. This arrangement, forming a three-step colinear antenna, further improves the communication efficient in the car telephone band. Also in AM and FM bands, the antenna's effective length is increased, and the antenna sensitivity is therefore improved.

Figure 10:
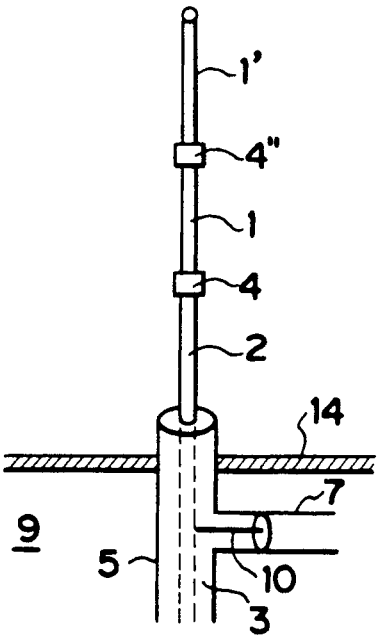
Figure 11:
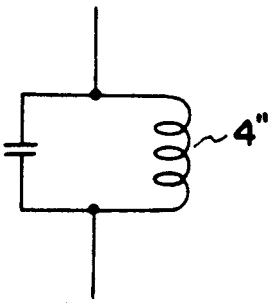

FIG. 10 shows a modification of the embodiment of FIG. 9 which uses, in lieu of the phase shifter 4', a trap circuit 4'' consisting of an L/C parallel resonance circuit as shown in FIG. 11, for example.

The trap circuit 4'' has the function of cutting high-frequency currents in the car telephone band, and therefore the antenna of FIG. 10 is equivalent to the two-step colinear type antenna in this band. In AM and FM bands, however, since the trap circuit 4'' may be disregarded electrically, the antenna's effective length is increased, and the sensitivity is improved.

What is claimed is:

1. In a multi-frequency antenna which includes: a first rod; a second rod movably supported on said first rod by a phase shifter for extending and contracting movements relative to said first rod; a hollow third rod on which said first rod is movably supported and which is capable of accepting and storing said first and second rods therein; and outer pipe disposed around and immovably supporting said third rod, said outer pipe being supported by a car body so that a predetermined lengthwise portion of said outer pipe is disposed under the car body and is grounded at a predetermined position; a power feeding coaxial cable having a core connected to said third rod and having an outer skin ground connected to said outer pipe; antenna driving means for extending and contracting said second rod relative to said first rod and said first rod relative to said third rod and outer pipe; and impedance matching means which includes said third rod, said coaxial cable and said outer pipe being configured to form a coaxial line arrangement of an open trap type so that an input impedance of the outer pipe is continuous; the improvement comprising wherein said phase shifter is a dielectric element which is approximately λ/4 long electrically, is inserted in a portion of said first rod, and has second rod extending through an opening therein, and means defining between said first rod and said dielectric element an air gap having a selected size which effects a predetermined dielectric constant in the phase shifter, wherein the antenna gain and phase are dependent on said dielectric constant.

2. A multi-frequency antenna according to claim 1, including a fourth rod movably supported on said second rod, and a further phase shifter provided between said fourth and second rods.

3. A multi-frequency antenna according to claim 1, wherein said dielectric element is substantially cylindrical and has in an exterior surface thereof a circumferential groove, the region within said groove being said air gap.

4. A multi-frequency antenna according to claim 3, wherein said dielectric element has at one end thereof a radially outwardly extending annular flange which engages one axial end of said first rod, said groove being a shallow groove of rectangular cross section and extending axially from a location adjacent said flange to a location near an end of said dielectric element remote from said flange.

* * * * *